US005099278A

United States Patent [19]

Sato

[11] Patent Number: 5,099,278

[45] Date of Patent: Mar. 24, 1992

[54] APPARATUS FOR SWITCHING AND DRIVING A PLURALITY OF DRIVEN SYSTEM

[75] Inventor: Kenji Sato, Hachioji, Japan

[73] Assignee: Konica Corporation, Tokyo, Japan

[21] Appl. No.: 557,210

[22] Filed: Jul. 24, 1990

[30] Foreign Application Priority Data

Jul. 26, 1989 [JP] Japan ..... 1-194488
Jul. 27, 1989 [JP] Japan ..... 1-197488
Aug. 31, 1989 [JP] Japan ..... 1-225184

[51] Int. Cl.[5] ..... G03G 21/00; G03G 15/00

[52] U.S. Cl. ..... 355/200; 355/202; 355/245; 355/326; 74/335

[58] Field of Search ..... 355/200, 202, 245, 326, 355/327, 246, 296, 271, 277; 74/333, 335, 365, 375, 337.5; 192/415, 93 R

[56] References Cited

U.S. PATENT DOCUMENTS 2,540,573 2/1951 Evans et al. ..... 74/337.5 X
2,740,509 4/1956 Le Cavelier ..... 74/337.5 X
2,742,795 4/1956 Wommelsdorf ..... 74/337.5 X
4,074,574 2/1978 Schubert et al. ..... 74/335

FOREIGN PATENT DOCUMENTS 60-75850 4/1985 Japan .
60-76766 5/1985 Japan .
60-95456 5/1985 Japan .
60-95458 5/1985 Japan .
60-158475 8/1985 Japan .
61-100770 5/1986 Japan .
61-149972 7/1986 Japan .
0188565 8/1986 Japan ..... 355/245

*Primary Examiner*—A. T. Grimley
*Assistant Examiner*—Matthew S. Smith
*Attorney, Agent, or Firm*—Frishauf, Holtz, Goodman & Woodward

[57] ABSTRACT

The invention provides an apparatus for switching and driving a plurality of driven systems. There are provided a driving shaft coupled with a drive motor; a control shaft coupled with a position control motor; and a plurality of spring clutches and a plurality of cams each corresponding in number to the plurality of driven systems; wherein each of the plurality of spring clutches is connected to the driven shaft and associated with one of the plurality of cams for engaging or disengaging between the driving shaft and a driven shaft of one of the plurality of the driven systems in response to an actuation of an associated cam; and wherein the plurality of cams are connected to the control shaft so that each of the plurality of driven shafts is intermittently engaged with the driving shaft in accordance with a rotational position of the control shaft.

20 Claims, 14 Drawing Sheets

APPARATUS FOR SWITCHING AND DRIVING A PLURALITY OF DRIVEN SYSTEM

BACKGROUND OF THE INVENTION

This invention relates to a drive unit for driving the developing device of a color image forming apparatus by electrophotography and for pressing or releasing the cleaning means and the transfer belt.

Various methods and apparatuses for producing color images by electrophotography have been proposed. Japanese Patent Publications Open to Public Inspection (hereinafter referred to as Japanese Patent O.P.I. Publications) No. 100770/1986, for example, indicates a method that latent images are formed and developed on the photosensitive drum which is an image carrying member according to the number of decomposed colors of the original image, each latent image is transferred to a transfer drum each time it is developed to form a multi-color image on the transfer drum, and the multi-color image is transferred to a recording paper to obtain a color copy. An apparatus using this method is required to mount a transfer drum large enough to transfer an image on the peripheral surface in addition to the photosensitive drum, and hence the apparatus inevitably becomes large and structurally complicated.

Japanese Patent O.P.I. Publications No. 149972/1986, for example, indicates a method that latent images are formed and developed on the photosensitive drum according to the number of decomposed colors of the original image, and a color toner image is transferred to the transfer material, each time it is developed, to obtain a multi-color copy. This method is difficult in keeping accurate registration of multi-color images and cannot produce a quality color copy.

There is another method available that the processing that latent images are formed on the photosensitive drum according to the number of decomposed colors of the original image and developed by color toners is repeated to registrate color toner images on the photosensitive drum, and the registrated color toner images are transferred to obtain a color image. The basic process of this multi-color image forming method is indicated in Japanese Patent O.P.I. Publications Nos. 75850/1985, 76766/1985, 95456/1985, 95458/1985, and 158475/1985 by the grantee of the present invention.

A multi-color image forming apparatus for obtaining color images by this registration method is equipped with a plurality of developing devices containing different color toners on the periphery of the photosensitive drum. The photosensitive drum generally rotates more than once and latent images on the photosensitive drum are developed to produce color images.

A plurality of developing devices containing different color developers respectively which are mounted on the periphery of the photosensitive drum operate alternately for forming images and develop latent images to form toner images. During development, the development bias voltage is applied to the development sleeve by rotating the development sleeve and the stirring roller. Each of a plurality of developing devices is equipped with a drive motor for rotating it, and the ON or OFF operation of the motor is automatically controlled. Or, one motor is used as a power source to transfer power to a plurality of developing devices, ON-OFF switching means using an electromagnetic clutch or ON-OFF switching means using a solenoid and a spring clutch are mounted between the power transfer systems, and the rotation of the developing devices is controlled by operating the switching means.

Since toners are consumed by development during image forming, if the development is continuously performed without supplying toners, the toner ratio of the developer decreases when a two-component developer is used and quality images cannot be obtained. Therefore, each developing device is connected to a toner box containing a toner. When the toner ratio of the developer in a developing device, for example, decreases, the toner is supplied from the toner supply box to the developing device.

To switch or drive the toner supply boxes, a small motor which is mounted on each toner supply box is used. The motor is driven for a predetermined time to supply the toner when a decrease of the toner density is detected. It causes an increase in cost to mount and operate motors for driving the developing devices and for driving or switching the toner supply boxes or to mount and electrically control expensive electromagnetic clutches. When a color image forming apparatus for registrating toner images on the photosensitive drum and transferring them on a recording paper is to be used, a transfer belt which is used as a transfer means and a blade and fur brush which are used as cleaning means are required to be kept away from the photosensitive drum while forming a toner image to prevent the toner image from damage. It is also required for forming the next image that the transfer belt is pressed to the photosensitive belt when the image forming is finished to transfer a toner image to a recording paper, and the cleaning means are pressed to the surface of the photosensitive drum for cleaning when the transfer is finished.

A pressing and pressing-release facility using a powerful solenoid or motor rotation is used for pressing or releasing the cleaning means and the transfer belt. When a powerful solenoid is used, electrical interferences such as noise occur. When a motor is used, the cleaning means and the transfer belt require complicated mechanisms and control and resultant high costs.

SUMMARY OF THE INVENTION

The first object of the present invention is to solve the above problems and to provide a drive unit for a color image forming apparatus which allows for driving the developing devices and driving or switching the toner supply at low costs and for pressing or releasing the cleaning means and the transfer belt.

The present invention is a switching and driving unit for a plurality of driven systems, which are switched and driven in a predetermined order, characterized in that the drive shafts of the plurality of driven systems are connected via spring clutches respectively to the shafts which is rotated by the drive motors, and a plurality of cams operating the spring clutches are mounted to the shafts which are rotated by a pulse motor. The above object is accomplished by this basic configuration.

The drive unit of the present invention requires no electrical parts except the drive motor, pulse motor, and the drive control circuit because a plurality of cams for operating each spring clutch are mounted to the shaft which is rotated by the pulse motor with the phase shifted so that the operation is performed in a predetermined order, providing low costs and low possibilities of failure occurrence.

In a drive unit for switching and driving a plurality of developing devices in a predetermined order, which is an application example of the basic configuration of the present invention, the shaft of the developing member of each developing device is connected to the drive motor via each clutch which is controlled in ON or OFF by the cam so that the rotation of the motor is transferred to it, and the shaft of the toner feeding member of each developing device is connected to the drive motor via each clutch which is controlled in ON or OFF by the cam and the common clutch which is controlled in ON or OFF by an electrical signal, and the cams for controlling each clutches for the developing member and the toner feeding member are connected to the motor so that the rotation is transferred by one pulse motor by matching the phases for turning each clutches of the same developing device ON or OFF.

In the drive unit of the present invention for a plurality of developing devices with the foregoing configuration, since the developing members of the developing devices can be driven in a predetermined order of the developing devices by shifting the phase of each cam for turning the clutches for the developing devices ON or OFF and by turning the cam by the shift amount of the phase using the pulse motor, and the toner can be fed properly to each developing device by controlling the common clutch to the toner feeding members of the developing devices in ON or OFF according to the toner image density information of the developing device which is in operation by the driven developing member and to the toner image density information of the developer, necessary electrical parts are one or two drive AC motors for driving the developing members and toner feeding members, one pulse motor for driving the cams, and the common electromagnetic clutch which is turned ON or OFF by an electrical signal, providing low possibilities of failure occurrence and low costs.

In a color image forming apparatus, which is an application example of the basic configuration of the present invention and structured so that the developing devices with a plurality of toner feeing members and the cleaning means and transfer belt to be pressed or released are mounted on the periphery of the photosensitive drum, the cleaning means and transfer belt are released to drive the developing devices alternately and to form color images on the photosensitive drum, and the cleaning means is pressed for cleaning after the transfer belt is pressed for transfer, a power transfer system from one drive source is formed for the developing devices and the toner feeding members respectively, spring clutches corresponding to the developing devices and toner feeding members are mounted to the power transfer systems, the spring clutches switch and drive the developing devices and toner feeding members by cams which rotate by one pulse motor, cams for pressing or releasing the cleaning means and the transfer belt are mounted on the side of the photosensitive drum, and each cam rotates a quarter of one revolution when a gear driven by the pulse motor rotates one revolution.

The second object of the present invention is to provide a development drive unit for a color image forming apparatus which allows for selecting a developing device to be operated freely such as skipping one or two developing devices instead of selecting developing devices in the location order or in a predetermined fixed order.

The second object is accomplished by a development drive unit for a color image forming apparatus characterized in that a branched power transfer system from one drive source is formed for a plurality of developing devices of the color image forming apparatus, in which the developing devices are mounted on the periphery of the image carrying member and alternately driven to form color images, spring clutches corresponding to the developing devices are mounted to the branched power transfer system, the spring clutches switch the drive by cams which rotate by one pulse motor, and the peripheral speed of the cams is almost equal to that of the spring clutches at the contact.

PREFERRED EMBODIMENT OF THE INVENTION

The basic configuration of the present invention is that when branched power transfer systems, for example, are formed to a plurality of developing devices from one motor, a spring clutch is mounted in each branched power transfer system. Cams which rotate by one pulse motor are mounted opposite to the spring clutches of the developing devices, and the rotation is transferred or not transferred (loose rotation) according to the location of each facing cam.

Figure 1:
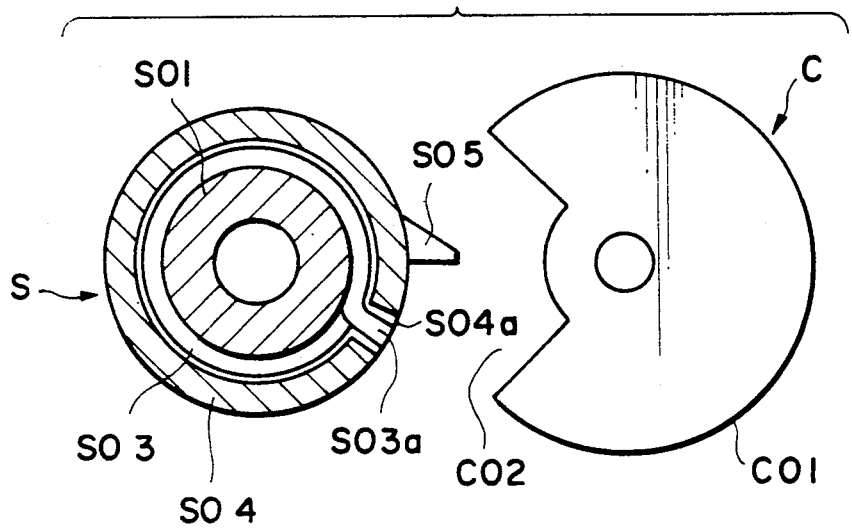
FIG. 1 is a sectional view for explaining the spring clutch operation.

FIG. 1 shows the relative position of the cross section of a spring clutch and a cam. The spring clutch S is equipped with a shaft S01 which is a drive shaft, and a spiral spring S03 is attached closely to the shaft S01. A sleeve S04 which is a follower shaft is mounted round the spiral spring S03, and one end S03*a* of the spiral spring S03 is protruded into a slot S04*a* of the sleeve S04. A protruded clutch pin S05 is attached to the sleeve S04.

A cam C opposite to the spring clutch S is a face cam which comprises a convex C01 and a concave C02. This clutch spring is a so-called closed type. When the concave C02 of the cam C is opposite to the spring clutch S as shown in FIG. 1, the clutch pin S05 is in the freely movable state and the power is transferred. When the convex C01 is opposite to the spring clutch S, the clutch pin S05 is obstructed in movement, the spiral spring S03 slips on the shaft S01, and no power is transferred.

Figure 2:
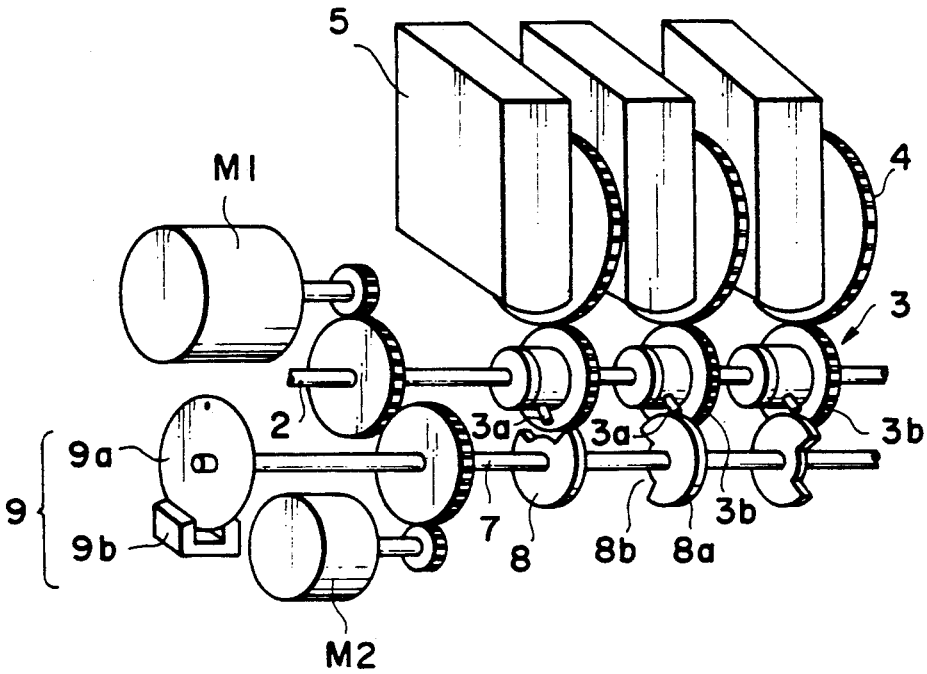
FIG. 2 is a perspective view of a drive unit of the present invention.
Figure 3:
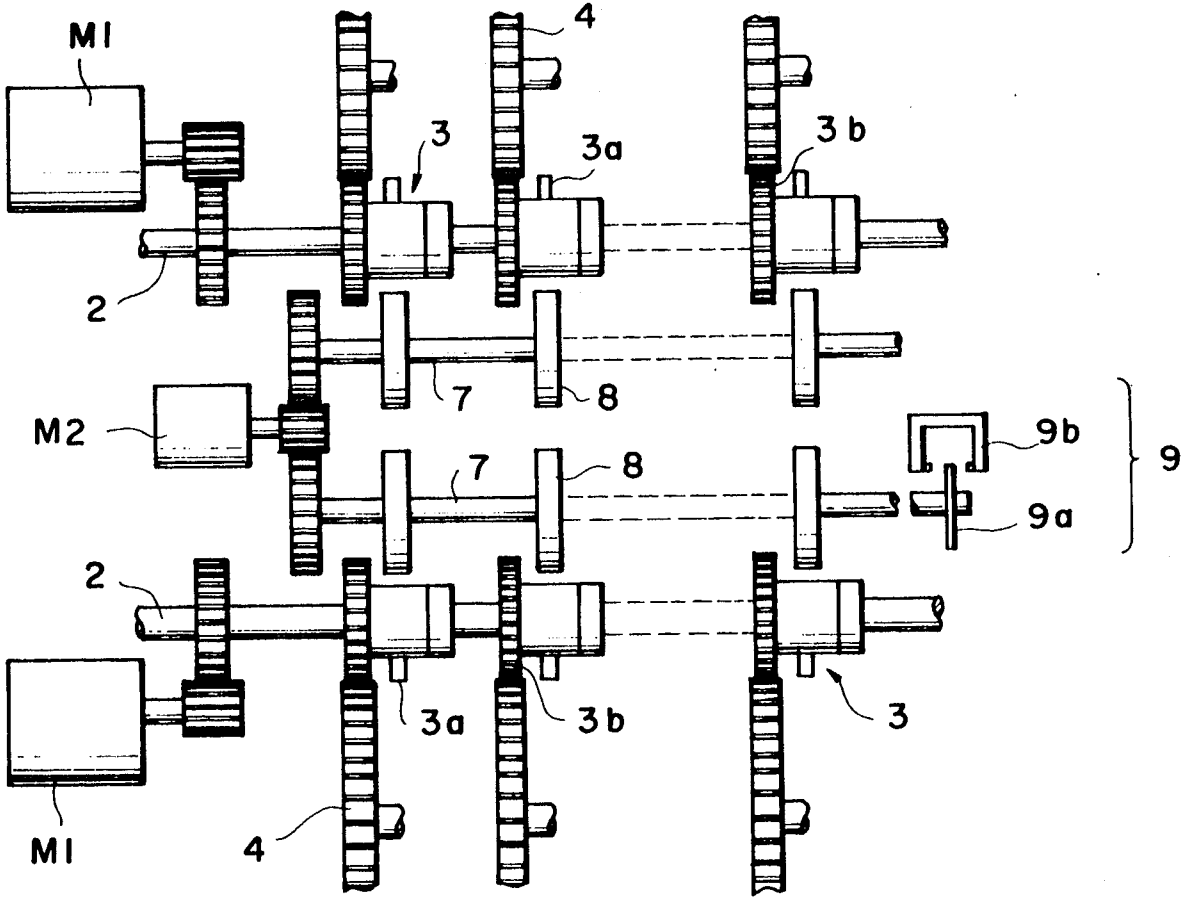
FIG. 3 is a side view of the drive unit shown in FIG. 2.

FIG. 2 is a perspective view of a drive unit of the present invention, and FIG. 3 is a side view of the drive unit shown in FIG. 2. In both figures, a symbol M1 indicates a drive motor, numeral 2 a clutch shaft which rotates by the drive motor M1 via a gear train, 3 a spring clutch which is in the rotation transfer state when a clutch pin 3*a* is not held such that a clutch gear 3*b* rotates, as mentioned above, together with the clutch pin 3*a* and the clutch shaft 2 are in the rotation OFF state when the clutch pin 3*a* is held such that the clutch gear 3*b* and the clutch pin 3*a* slip on the clutch shaft 2 and stop, 4 a drive gear of a driven system which is engaged with the clutch gear 3*b* of the spring clutch 3, 5 a driven system casing, for example, such as a developing device casing, M2 a pulse motor, 7 a cam shaft which rotates by the pulse motor M2 via a gear train, 8 a cam having a holding part 8*a* for the clutch pin 3*a* and a non-holding part 8*b*, and 9 a cam shaft 7 home position detection means comprising a home position hole plate 9*a* fixed to the cam shaft 7 and a hole detection means 9*b* using a light emission-reception element.

The drive unit shown in FIG. 2 comprises one clutch shaft 2 to which the rotation is transferred from one drive motor M1 and one cam shaft 7 to which the rotation is transferred from one pulse motor M2. The drive unit shown in FIG. 3 comprises two sets of clutch shaft 2 to which the rotation is transferred from one drive motor M1 and two cam shafts 7 to which the rotation is transferred from one pulse motor M2 in the first system.

The operation of the drive unit shown in FIG. 2 is as follows: When the pulse motor M2 allows the cam shaft 7 to stop in the home position at such a rotation position phase that the holding parts 8*a* of a plurality of cams 8 attached to the clutch shaft 7 interfere with clutch pins 3*a* of a plurality of spring clutches 3 attached to the clutch shaft 2 respectively even if the clutch shaft 2 rotates by the rotation of the drive motor M1, all the clutch pins 3*a* of the spring clutches 3 are held by the holding parts 8*a* of the cams 8, and all the clutch gears 3*b* of the spring clutches 3 slip on the clutch shaft 2, and the drive shaft gears 4 of the driven system which engage with the clutch gears 3*b* will not rotate. Then, the pulse motor M2 rotates the cam shaft 7 in one direction. When the rotation position phase of the cam shaft 7 is changed to a phase where the left end cam 8, for example, directs the non-holding part 8*b* toward the left end spring clutch 3 first as shown in the figure, the clutch pin 3*a* of the spring clutch 3 is not interfered by the cam 8, and the spring clutch 3 rotates together with the clutch shaft 2, the clutch gear 3*b* also rotates, and then the left end drive shaft gear 4 of the driven system which engages with the clutch gear 3*b* rotates. When the pulse motor M2 rotates the cam shaft 7 furthermore in one direction then and the rotation position phase of the cam shaft 7 is changed to a phase where the center cam 8 shown in the figure, for example, directs the non-holding part 8*b* toward the center spring clutch 3, the left end clutch pin 3*a* is held by the holding part of the cam 8 once again, and the left end drive shaft gear 4 of the driven system is stopped once again, the clutch pin 3*a* of the center spring clutch 3 is not interfered by the cam 8 instead, the spring clutch 3 rotates together with the clutch shaft 2, the clutch gear 3*b* also rotates, and then the center drive shaft gear 4 of the driven system which engages with the clutch gear 3*b* rotates. By rotating the cam shaft 7 by the pulse motor M2 in the same way, the drive shaft gears 4 of a plurality of driven systems can be sequentially switched and rotated. The above rotation for changing the rotation position phase of the cam shaft 7 by the pulse motor M2 is controlled according to the home position information provided by the home position detection means 9 and the pulse counter information of a pulse signal for driving the pulse motor M2.

The operation of the drive unit shown in FIG. 3 shows that the upper part and the lower part of the pulse motor M2 perform the operation equal to that of the drive unit shown in FIG. 2.

In a drive unit of the present invention, including the shown example, the rotation may be transferred from one drive motor to a plurality of clutch shafts and a plurality of sets that the rotation is transferred from one pulse motor to one cam shaft may be provided. When the load of the driven system is comparatively high, open type spring clutches which transfer the rotation to the driven system when interfered by the cams may be used.

The present invention produces satisfactory results such as low costs and low possibilities of failure occurrence because a unit for switching and driving a plurality of driven systems requires a small number of electrical parts.

Figure 4:
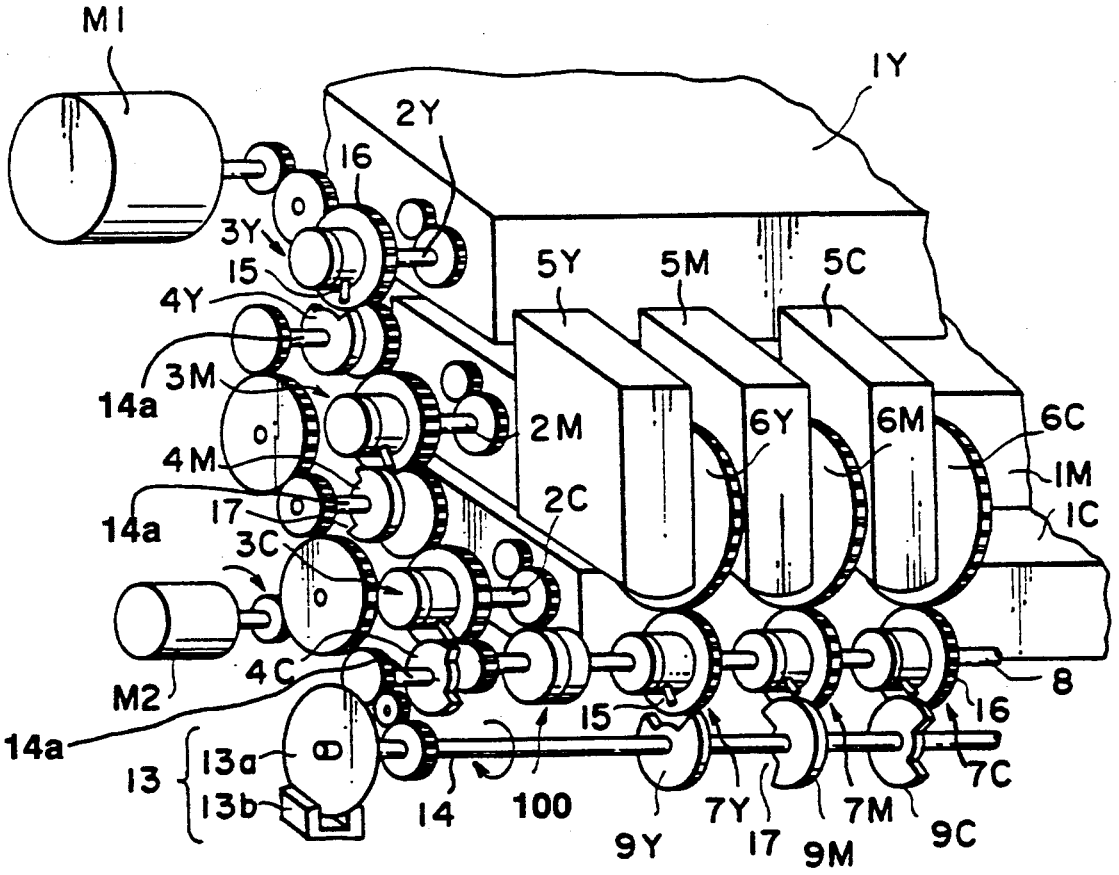
FIG. 4 is a perspective view of a drive unit of the present invention which is applied to a plurality of developing devices.

FIG. 4 is a perspective view of an application example of a drive unit of the present invention. In the figure, numerals 1Y, 1M, and 1C indicate casings of developing devices using yellow, magenta, and cyan toners, 2Y, 2M, and 2C drive shafts of developing members of the developing devices, 3Y, 3M, and 3C spring clutches which are controlled in ON or OFF by cams 4Y, 4M, and 4C, 5Y, 5M, and 5C casings of toner feeding members of the developing devices, 6Y, 6M, and 6C drive shaft gears integrated with the drive shafts of the toner feeding members, 7Y, 7M, and 7C spring clutches which are attached to the clutch shaft 8, engaged with the drive shaft gears 6Y, 6M, and 6C, and controlled in ON or OFF by cams 9Y, 9M, and 9C, 10 an electromagnetic control clutch for controlling ON or OFF between the clutch shaft 8 and the drive unit by an electrical signal or an electric control clutch comprising a combination of a spring clutch and a solenoid, M1 an AC drive motor for driving the developing member and toner feeding member of each developing device, M2 a pulse motor for rotating the cams 4Y, 4M, 4C, 9Y, 9M, and 9C by gear trains, and 13 a cam shaft 14 home position detection means using a home position hole plate 13*a* and a hole sensor 13*b* comprising a combination of a light emission element and a light reception element for detecting the hole of the home position hole plate 13*a*.

When the clutch pin 15 is held by the cam 4Y, 4M, or 4C, or 9Y, 9M, or 9C and stopped to rotate, the spring clutch 3Y, 3M, or 3C, or 7Y, 7M, or 7C enters the rotation OFF state because the clutch gear 16 slips on the clutch mounting shaft, that is, the drive shaft 2Y, 2M, or 2C, or the clutch shaft 8. When the clutch pin 15 is not held by the cam, the spring clutch enters the rotation ON state because the clutch gear 16 rotates together with the clutch mounting shaft. When a notch 17 of the cam 4Y, 4M, 4C, 9Y, 9M, or 9C is in the rotation phase opposite to the corresponding spring clutch 3Y, 3M, 3C, 7Y, 7M, or 7C, the clutch pin 15 is not held by the cam. When the notch is moved from the rotation phase, the clutch pin 15 is held at the peripheral surface or the end surface of the notch 17. The cams 4Y, 4M, and 4C are fixed to each cam shaft 14*a* which rotates by the pulse motor M2 via the gear train and the cams 9Y, 9M, and 9C are fixed to the cam shaft 14 so that the phases of the notches 17 for the same developing device of 4Y and 9Y, 4M and 9M, or 4C and 9C are the same and the phases of the notches 17 of the developing devices of different toners Y, M, and C are quite different from each other.

In the drive unit with the above configuration shown in FIG. 4, when the notches 17 of the cams 4Y, 4M and 4C, accordingly 9Y, 9M, and 9C are set in a rotation phase shifted from the rotation phase opposite to the spring clutch and the electric control clutch 100 is in the OFF state, the rotation of the drive motor M1 allows the section from the clutch gear 16 of the spring clutch 3Y, 3M, or 3C to the drive side of the electric control clutch 100 to rotate but does not allow the drive shaft 2Y, 2M, or 2C of the developing member or the clutch shaft 8 and following section to rotate, and all the developing devices and toner feeding members are stopped. Even if only the electric control clutch 100 is changed to the ON state in this stop state, the section up to the clutch shaft 8 rotates but the clutch gear 16 of the spring clutches 7Y, 7M, and 7C and the following do not rotate, resulting in nothing changed. When the pulse motor M2 is rotated clockwise, for example, in this state until the cams 4Y and 9Y are set in the rotation phase such that the clutches 17 of the cams 4Y and 9Y are opposite to the spring clutches 3Y and 7Y first as shown in the figure, the spring clutch 3Y transfers the rotation of the clutch gear 16 to the drive shaft 2Y of the developing member because the rotation of the clutch pin 15 is not held by the cam 4Y, and the spring clutch 7Y transfers the rotation of the clutch shaft 8 from the clutch gear 16 to the drive shaft gear 6Y of the toner feeding member because the rotation of the clutch pin 15 is not held by the cam 9Y, and the developing operation of the casing 1Y and the toner feeding operation of the casing 5Y according to the ON or OFF control of the electric control clutch 100 are performed.

When the pulse motor M2 is rotated clockwise once again until the cams 4M and 9M are set in the rotation phase such that the clutches 17 of the cams 4M and 9M are opposite to the spring clutches 3M and 7M, the developing operation of the casing 1M and the toner feeding operation of the casing 5M are performed in the same way, and the casings 1Y and 5Y are stopped. As mentioned above, by changing the rotation position phase of the cam by the pulse motor M2, the developing device can be sequentially changed and driven.

The foregoing rotation for changing the rotation position phase of the cam by the pulse motor M2 is precisely performed according to the detection information of the home position detection means 13 and the pulse count information of a pulse signal for driving the pulse motor M2. The ON or OFF control of the electric control clutch 100 is performed according to the toner image density information which is switched whenever the developing device is switched for driving or the toner density information of the developer.

In addition to the examples of the present invention shown in the figures, the number of developing devices may be 2, 4, or more, the developing operation and the toner feeding operation may be performed by independent drive motors, or an independent clutch may transfer the rotation when it is interfered by the cam but not transfer the rotation when it is not interfered.

The present invention produces satisfactory results such as low possibilities of failure occurrence and low costs because a drive unit for switching and driving a plurality of developing devices of a color image copying apparatus requires a small number of electrical parts.

Next, a color image forming apparatus which drives developing devices and controls the toner feeding operation using an appropriate combination of spring clutches S and cams C comparatively low in price, and drives and controls the transfer belt and the cleaning means with one motor will be described hereunder as an application example of the present invention.

This application example of the present invention is on the basis that the phases I to IV for pressing (ON) and releasing (OFF) the transfer belt to or from the photosensitive drum and for pressing (ON) and releasing (OFF) the cleaning means to or from the photosensitive drum, indicated below, are repeated for forming images.

| Phase | I | II | III | IV |
|---|---|---|---|---|
| Transfer belt | OFF | ON | ON | OFF |
| Cleaning | OFF | OFF | ON | ON |

A means for repeating the above phases is structured such that transfer belt and cleaning means cams which are integrated are mounted to one side (preferably both sides) of the photosensitive drum, the phases I to IV are performed while the integrated cams make one revolution, the transfer belt or the cleaning means is in the OFF state when it is in contact with the cam, the integrated cams make a quarter revolution when the gear which transfers the rotation of the motor for driving the cams to execute the phases I to IV sequentially, and a spring clutch is attached to the gear to control the operation.

Figure 5:
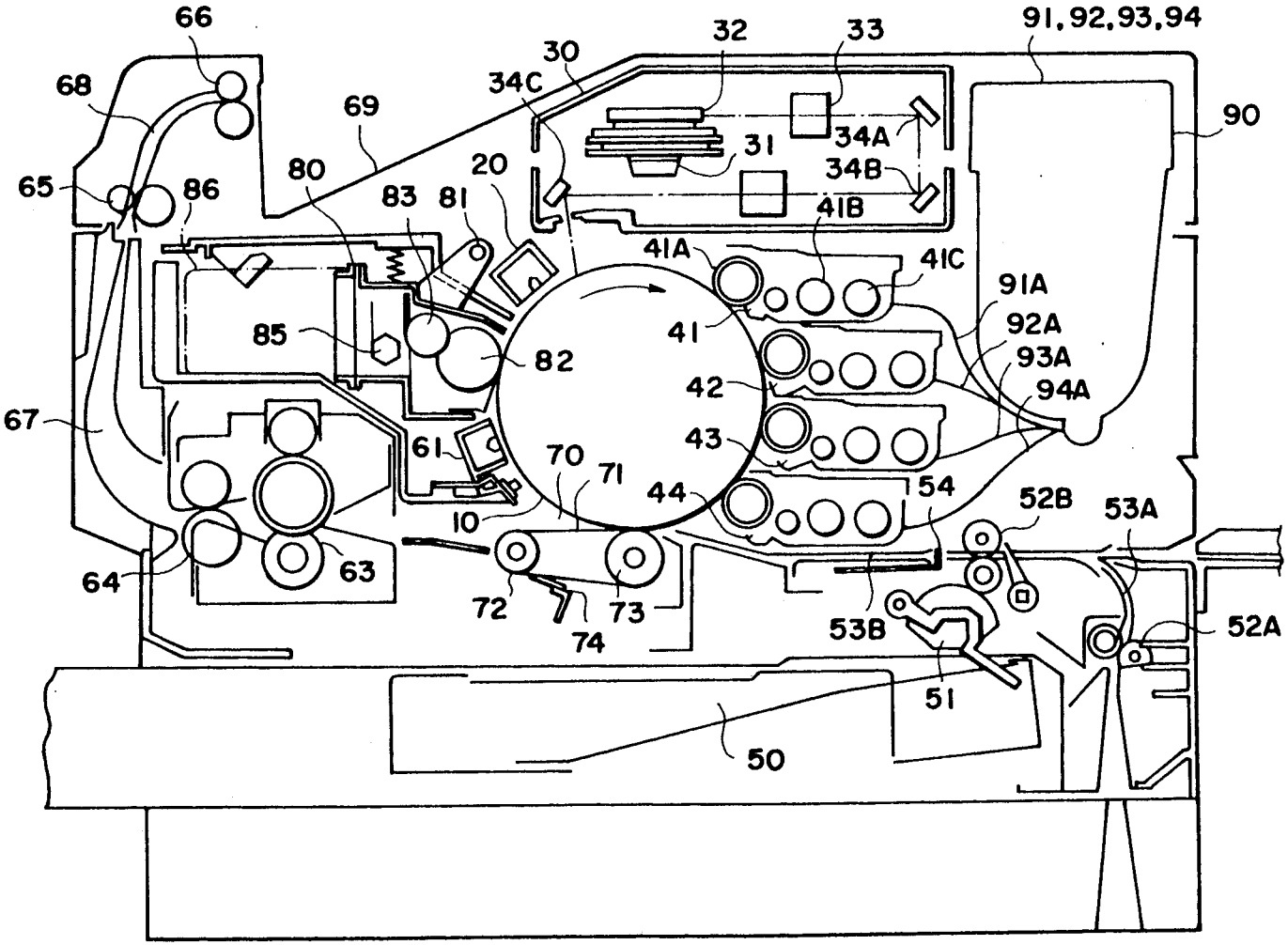
FIG. 5 is a sectional view of a color image forming apparatus.

FIG. 5 shows the configuration of an embodiment of a color image forming apparatus of the present invention. The embodiment will be described hereunder with reference to the figure. The present invention may use a configuration other than the above.

In the figure, numeral 10 indicates a drum-shaped image carrying member or a photosensitive drum 100 mm in diameter which is coated with an OPC photosensitive layer on the peripheral surface and rotated clockwise. Numeral 20 indicates a charging electrode for charging the photoconductor on the peripheral surface of the photosensitive drum 10, and 30 a laser write system unit which is an exposure optical system.

When a color signal outputted from an image reader which is different from the above image forming apparatus is supplied to the laser write system unit 30, a laser beam generated from a semiconductor laser (not shown in the figure) is rotated and scanned by a polygon mirror 32 which is rotated by a drive motor 31, bent in optical path by three mirrors 34A, 34B, and 34C via a f0 lens 33, and irradiated onto the peripheral surface of the photosensitive drum 10 which is charged by the charging electrode beforehand.

When the scanning starts, the laser beam is detected by an index sensor, the first color signal starts modulation of the laser beam, and the modulated laser beam scans the peripheral surface of the photosensitive drum 10. Therefore, a latent image for the first color is formed on the peripheral surface of the photosensitive drum 10 by main scanning of the laser beam and by subscanning by the rotation of the photosensitive drum 10. This latent image is developed by a developing device 41 containing, for example, a yellow toner as a first color to form a yellow toner image on the peripheral surface of the photosensitive drum 10. The obtained toner image which is retained on the peripheral surface of the photosensitive drum 10 passes under the cleaning means 80 away from the peripheral surface of the photosensitive drum 10, and the next copy cycle starts.

The photosensitive drum 10 is charged once again by the charging electrode 20, the second color signal outputted from a signal processing unit is supplied to the write system unit 30, and the writing by the second color signal is performed on the peripheral surface of the photosensitive drum 10 in the same way as the first color signal to form a latent image. The latent image is developed by a developing device 42 containing, for example, a magenta toner as a second color. This magenta toner image is formed on the foregoing yellow toner image.

The obtained toner image which is retained on the peripheral surface of the photosensitive drum 10 passes under the cleaning means 80 away from the peripheral surface of the photosensitive drum 10, and the next copy cycle starts.

The writing is performed by the third color signal on the photosensitive drum 10 in the same way to form a latent image. This latent image is developed by a developing device 43 containing, for example, a cyan toner as a third color. This cyan toner image is formed on the foregoing yellow and magenta toner image.

In this way, a color toner image is formed on the photosensitive drum 10 using three color toners. By forming furthermore a black toner image on the three-color toner image, a high quality color image can be obtained.

Numerals 41 to 44 indicate developing means or developing devices containing a yellow, magenta, cyan, and black toner respectively.

As shown in an example of the developing device 41, each of the foregoing developing devices comprises a developing sleeve (41A) containing a fixed magnetic pole which is opposite to the peripheral surface of the photosensitive drum 10 at a predetermined interval and a pair of stirring rollers 41B and 41C which have feeding force in the reverse directions. The toner and carrier components of the developer is made uniform by the mixing action of the stirring rollers 41B and 41C, and the mixed developer is fed to the peripheral surface of the rotating developing sleeve 41.

A DC or additionally an AC bias voltage is applied to the developing sleeve of each developing device carrying a developer, and non-contact reverse developing is performed by the 2-component developer.

Charging by the photosensitive drum 10 and the charging electrode 20 mounted around the surface of the drum, exposure by the laser write system unit 30, and developing by the developing devices 41 to 44 are performed for each color; that is, four times in total to form a color toner image on the peripheral surface of the photosensitive drum 10 by the registration method.

Numeral 50 indicates a paper feed cassette and 51 a paper ejection roller. Recording papers piled up in the paper feed cassette are fed by the action of the paper ejection roller 51 one by one starting at the top paper.

Numerals 52A and 52B indicate a first paper feed roller and a second paper feed roller which are rotating always, and 53A and 53B a circular and a linear paper guide.

A recording paper fed from the paper feed cassette 50 is conveyed by the first paper feed roller 52A along the paper feed guide 53A to make a U-turn or to turn upside down, and then gets in touch with the vertical section of the paper feed shutter 54 which blocks the feed path of the paper feed guide 53B and stops. In this case, the second paper feed roller 52B continues rotation by slipping on the recording paper in the stop state.

When the paper feed shutter 54 moves down in synchronization with the rotation of the photosensitive drum 10 having a toner image on it, the recording paper is fed to a transfer unit 70 in synchronization with the peripheral speed of the photosensitive drum 10 by the frictional force of the second paper feed roller 52B.

Numeral 71 indicates a transfer belt, which is stretched between a drive roller 72 and a transfer roller 73 and rotates counterclockwise at a speed equal to the peripheral speed of the photosensitive drum 10. The transfer belt 71 is pressed to or released from the photosensitive drum 10 using the drive roller 72 as an oscillation center. The transfer roller 73 is a roller which is applied with a voltage or charged and can freely rotate. When the transfer belt is pressed to the photosensitive drum 10, the transfer roller 73 configures a transfer unit 70 for transferring a toner image on a recording paper via the transfer belt 71 at the contact with the peripheral surface of the photosensitive drum 10. Therefore, a toner image is transferred while the recording paper is being conveyed by the transfer belt 71. Numeral 74 indicates a cleaning means for cleaning the surface of the transfer belt 71.

Numeral 61 indicates a precharging electrode which is located on the upper stream of the cleaner 80 and charges the remaining toner on the peripheral surface of the photosensitive drum 10, which transfers a toner image on a recording paper, so as to be easily removed.

The cleaner 80 is pressed to or released from the photosensitive drum 10 using the oscillation shaft 81 as an oscillation center. Numerals 82 and 83 indicate a conductive cleaning brush and a conductive collection roller which are cleaning means of the cleaner 80, and 84 a waste toner collection unit for containing toners collected by the cleaning means.

The remaining toner is removed from the photosensitive drum 10, which passes the precharging electrode 61, by the cleaning brush 82 which is in the sliding state by a signal from the control unit, and the remaining toner attached to the brush 82 are adsorbed to the collection roller 83 and sent to the waste toner collection unit 84.

The waste toner collection unit 84 comprises a waste toner feed bar 85 and flexible toner collection bag 86. The remaining toners or waste toners fed by the collection roller 83 are sent into the toner collection bag 86 via the the waste toner feed bar 85.

The photosensitive drum 10, the peripheral surface of which is cleaned, is charged once again by the charging electrode 20 and starts forming a new image, and the cleaning brush 82 is released from the sliding state. The recording paper, which a toner image is transferred to by the transfer unit, is separated from the peripheral surface of the photosensitive drum 10 and sent to the fixing device. Numeral 63 indicates fixing heat rollers and 64 paper ejection rollers. The recording paper, the toners on which are melted and fixed by the heat rollers 63, are ejected from the fixing device by the paper ejection rollers 64.

Numerals 67 and 68 indicate paper ejection guides for leading the recording paper ejected by the paper ejection rollers 64 to the upper part of the apparatus. The recording paper is ejected and accumulated on a tray 69 by paper feed rollers 65 and 66 with the image side down.

A toner feeding unit 90 is shown on the upper right of FIG. 5. The toner feeding unit 90 comprises feeding toner containers 91, 92, 93, and 94 which are overlapped with each other on the figure. The containers contain yellow, magenta, cyan, and black feeding toners respectively. The feeding toner containers 91, 92, 93, and 94 and the developing devices 41, 42, 43, and 44 are connected with toner feeding tubes 91A, 92A, 93A, and 94A respectively. Each of the toner feeding tubes 91A, 92A, 93A, and 94A contains a screw. When the corresponding screw rotates by the power transferred by a signal from the control unit, the toner contained in the corresponding feeding toner container is fed to the developing device via the toner feeding tube.

Figure 6:
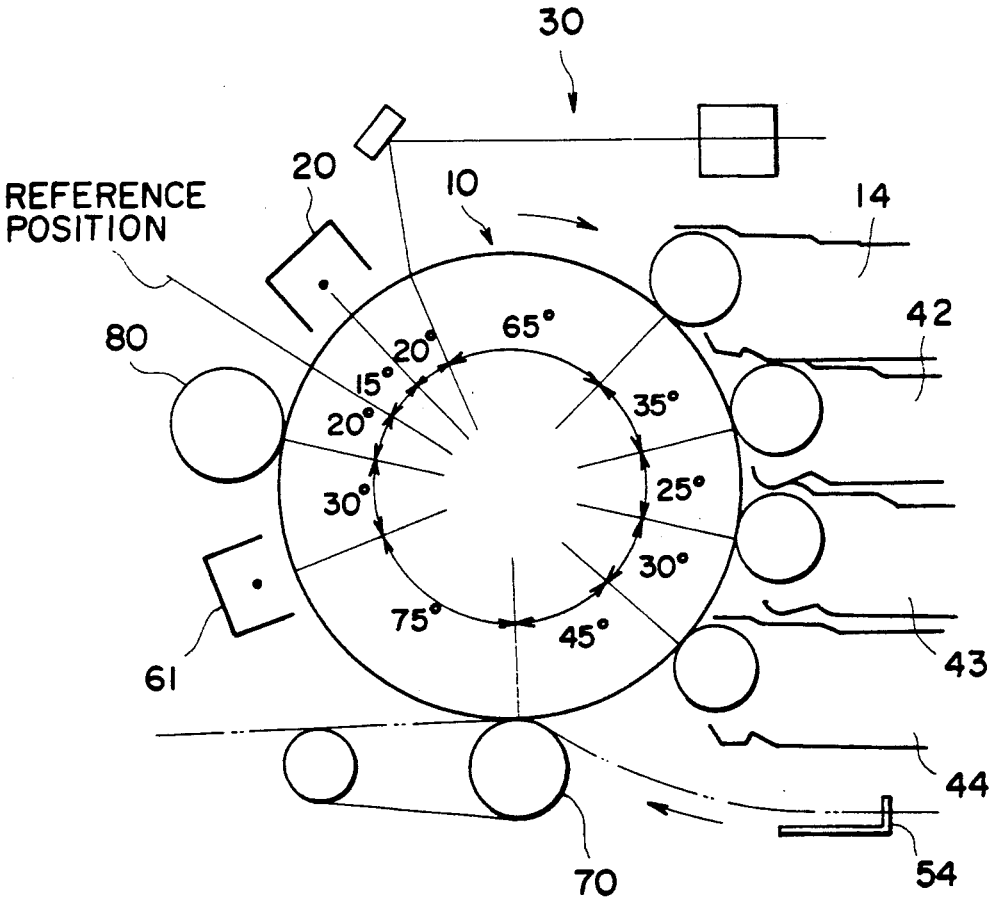
FIG. 6 is an illustration of the location of each unit of the color image forming apparatus shown in FIG. 5.
Figure 7:
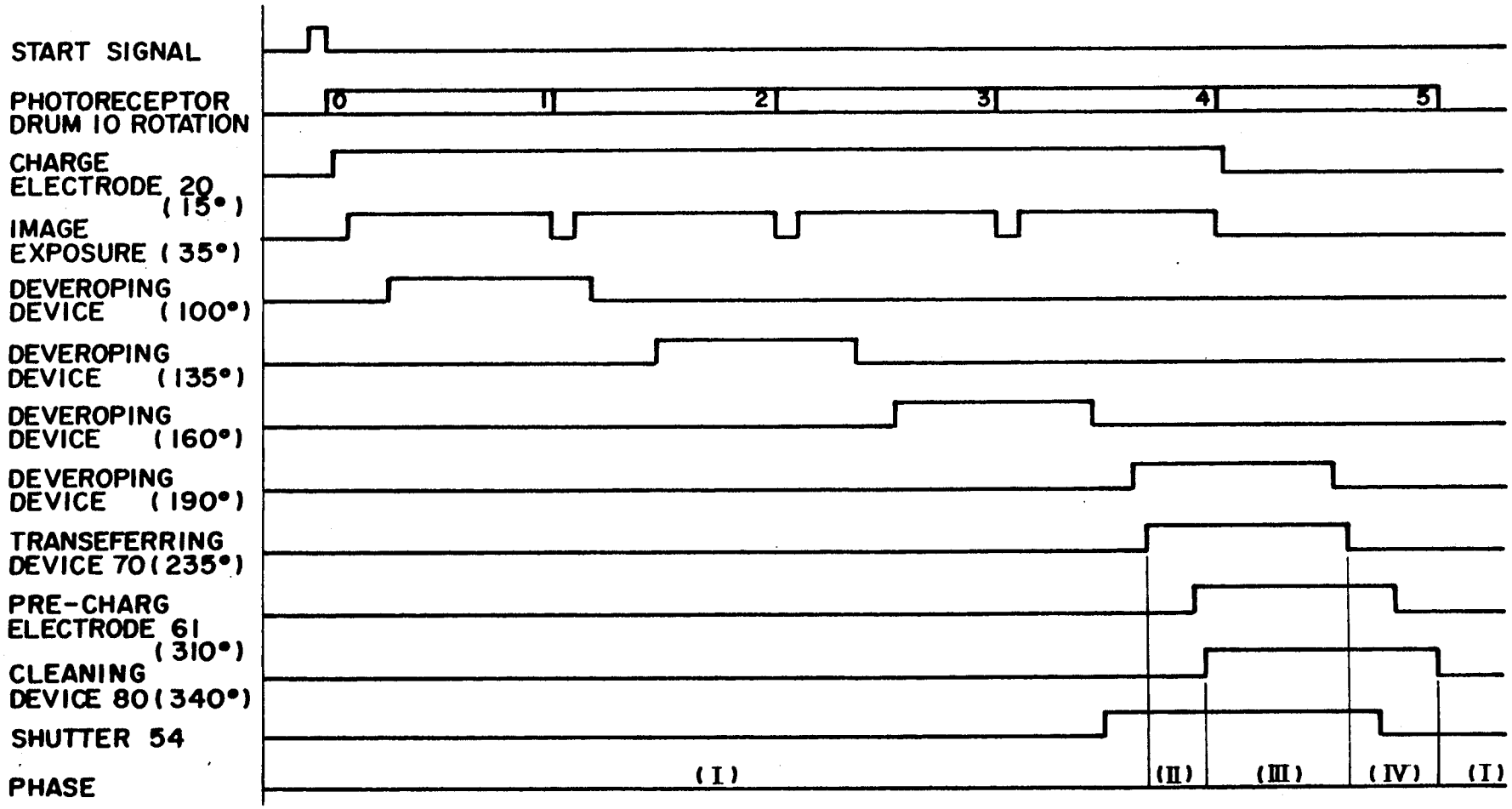
FIG. 7 shows an image forming timing chart under the location condition shown in FIG. 6.

FIG. 6 shows the locations of the image forming means on the periphery of the photosensitive drum of the color image forming apparatus shown in FIG. 5 which is described above. FIG. 7 shows an image forming timing chart of the color image forming apparatus shown in FIG. 6.

Figure 8:
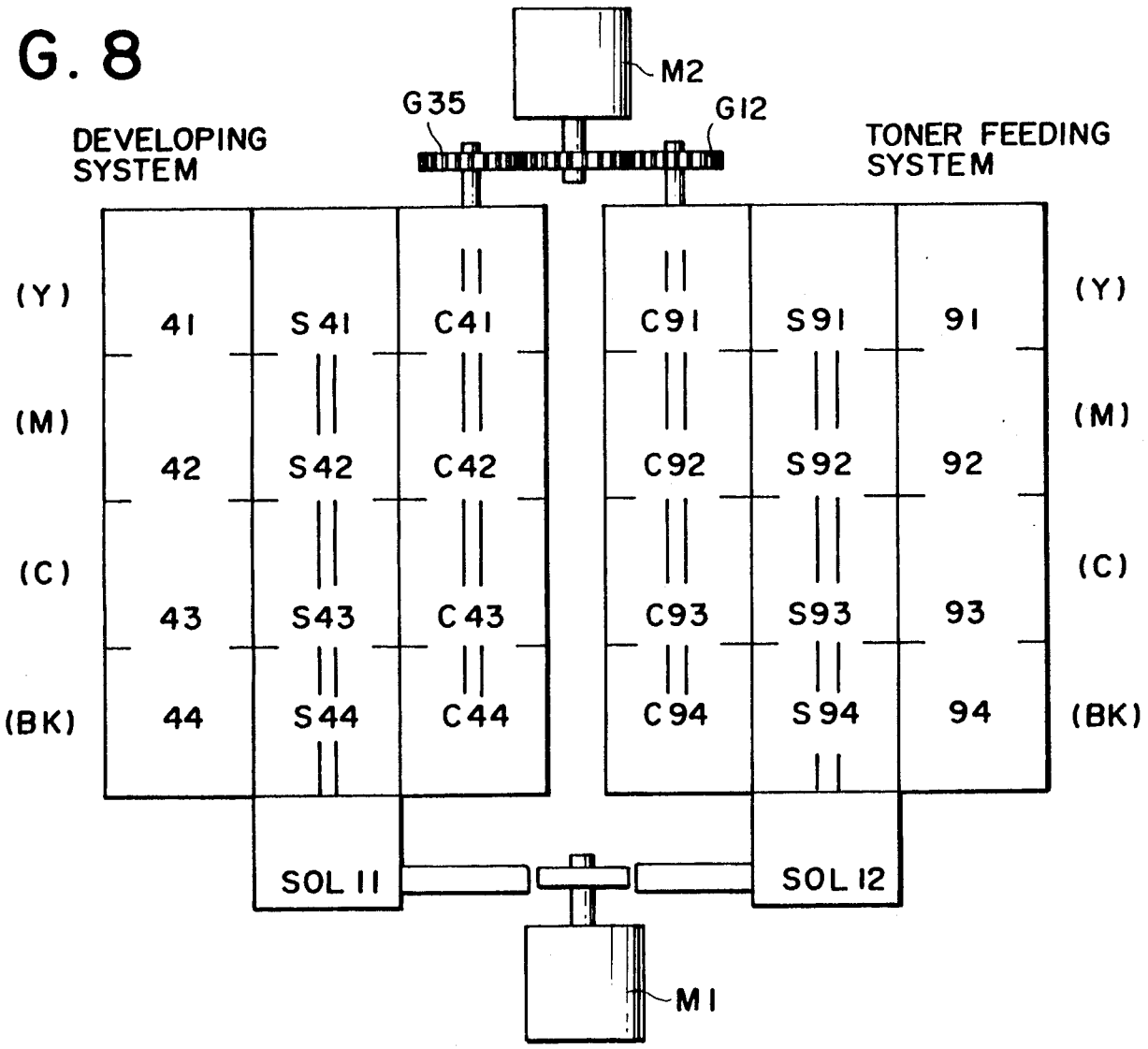
FIG. 8 shows a block diagram of a drive system of the present invention.

FIG. 8 is a block diagram of the developing device and toner feeding drive system and of the transfer belt and cleaner drive system. The above units can be easily driven by one drive motor and one cam drive motor.

Figure 9:
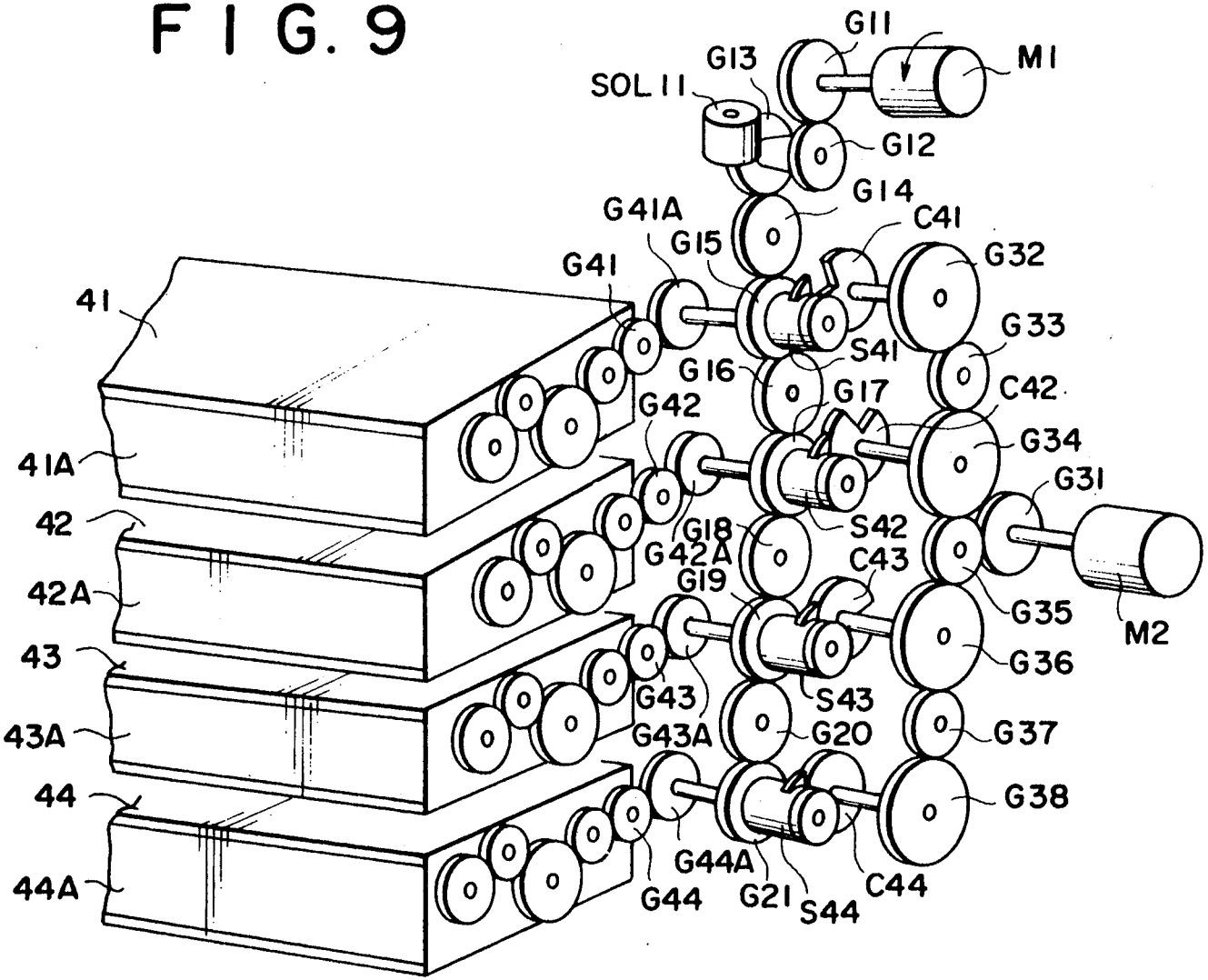
FIG. 9 is a perspective view of the drive system of a developing device.

FIG. 9 is a perspective view of the developing device drive system. In the figure, numerals 41, 42, 43, and 44 indicate developing devices containing yellow, magenta, cyan, and black toners previously described which are structurally equal or similar to each other. The developing devices are structured so as to function when gears G41, G42, G43, and G44 mounted to them rotate.

A symbol M1 indicates a motor for driving the developing devices and M2 a motor for driving the cams. An AC motor is used as a M1 motor and a pulse motor as a M2 motor. A gear train for developing device drive which is rotated by the motor M1 will be described hereunder. A gear G11 mounted to the motor M1 is engaged with a gear G12. A gear G13 is mounted coaxially with the gear G12, and a solenoid SOL11 for switching ON or OFF for developing drive is mounted between the gears G12 and G13. When the solenoid SOL11 is ON, the rotation of the gear G12 is that of the gear G13. When the solenoid SOL11 is OFF, the rotation of the gear G12 is not transferred to the gear G13.

Gears G13, G14, G15, G16, G17, G18, G19, G20, and G21 are engaged with each other in series. The gears G14, G16, G18, and G20 are idle gears which are used for making the developing device driving directions equal.

A gear G41A is mounted coaxially with the gear G15, and a spring clutch S41 for switching drive ON or OFF is mounted between the gears G15 and G41A. The relationship between gears G17 and G42A and a spring clutch S42, between gears G19 and G43A and a spring clutch S43, or between gears G21 and G44A and a spring clutch S44 is the same as above.

The gear G41A is engaged with a gear G41. In the same way, the gear G42A is engaged with a gear G42, the gear G43A with a gear G43, and the gear G44A with a gear G44. The gears are connected to the developing devices 41, 42, 43, and 44 respectively.

For cam drive, gears G32, G33, G34, G35, G36, G37, and G38 are engaged with each other in series, and the gear G35, which is located at the center of the gears, is engaged with a gear G31 mounted to the shaft of the motor M2.

A cam C41 is mounted coaxially with the gear G32. The cam C41 is a cam for switching the connection opposite to the spring clutch S41. The gear G34 and a cam C42, the gear G36 and a cam C43, and the gear G38 and a cam C44 are coaxially mounted respectively, and the connection is switched with the cams opposite to the spring clutches S42, S43, and S44 respectively.

Figure 10:
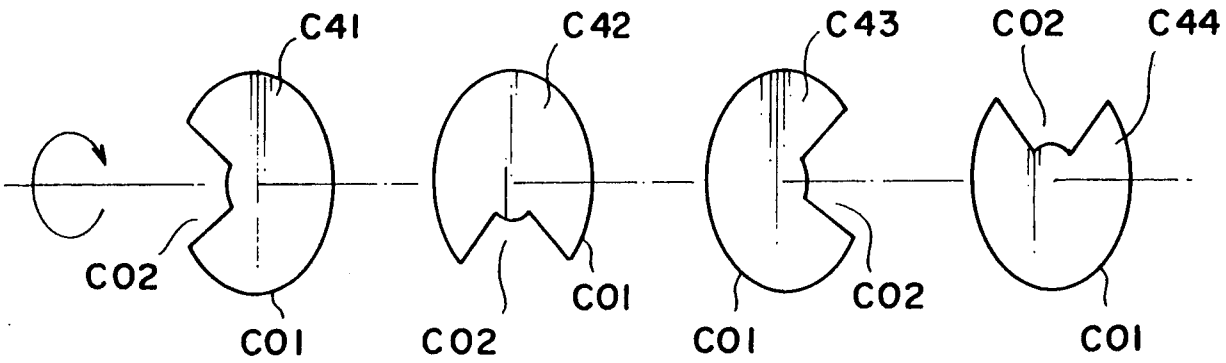
FIG. 10 is an illustration of the relationship of cam phases.

FIG. 10 shows the phase relation between the cams C41, C42, C43, and C44. The cams are similar in shape with a concave C02 of about 90°, and mounted at an angular interval of 90°.

In a developing drive unit of the configuration mentioned above, when the motor M1 is turned ON for copy, the solenoid SOL11 is turned ON for development, and a pulse motor or a rotary solenoid motor M2 is driven so that the cams C41, C42, C43, and C44, which rotate simultaneously in the same direction when the developing by one developing device is finished, can rotate in a 90° arc in one direction, the developing drive shown in the timing chart in FIG. 7 is cyclically performed to form a color image.

Figure 11:
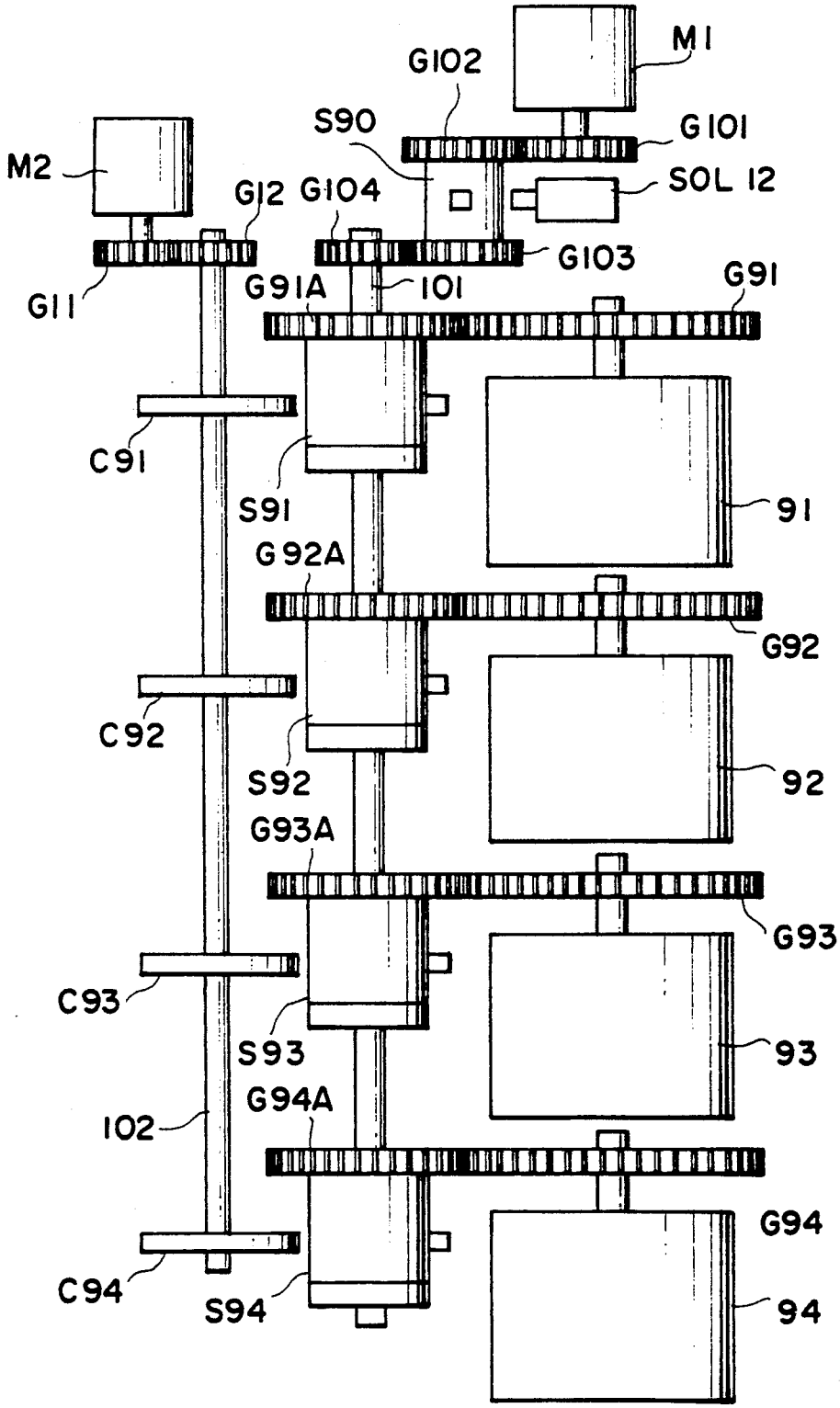
FIG. 11 is a plan view of the drive system of a toner feeding member.

FIG. 11 is a plan view showing the drive of toner feeding members for feeding toners from feeding toner containers to developing devices. In the figure, numerals 91, 92, 93, and 94 indicate feeding toner containers, previously described, in the same shape, which contain a yellow, a magenta, a cyan, and a black toner. Since a black toner is often consumed more in quantity than the other toners, the feeding toner container 94 may be larger in volume than the others.

The built-in toners of the feeding toner containers 91, 92, 93, and 94 are fed to the developing devices 41, 41, 43, and 44 via the toner feeding tubes 91A, 92A, 93A, and 94A by rotating gears G91, G92, G93, and G94 mounted on the sides of the containers.

The gear train for toner feeding drive which are rotated by the common drive motor M1 will be described hereunder. A gear G101 mounted to the shaft of the motor M1 is engaged with a gear G102. The gear G102 and a gear G103 are mounted coaxially via a spring clutch S90. A drive solenoid SOL12 with a protrusion which moves up and down is mounted on the side of the spring clutch S90. When a current through the solenoid SOL12 is turned ON or OFF, the spring clutch S90 switches the power to the gear G103 from ON to OFF or from OFF to ON.

A gear G104 which is engaged with the gear G103 is fixed to a shaft 101, to which a gear G91A is mounted via a spring clutch S91, and the gear G91A is engaged with the gear G91. Therefore, when the spring clutch S91 is turned ON or OFF, the rotation of the shaft 101 is transferred or not transferred to the gear G91. To the shaft 101, in the same way, a gear G92A which is engaged with the gear G92 via a spring clutch S92 is mounted, a gear G93A which is engaged with the gear G93 via a spring clutch S93 is mounted, and a gear G94A which is engaged with the gear G94 via a spring clutch S94 is mounted, and the spring clutches and gears perform the foregoing function.

For cam drive, the gear G11 mounted to the shaft of the motor M2 is engaged with the gear G12 fixed to a shaft 102. Cams C91, C92, C93, and C94 are fixed to the shaft 102 opposite to the spring clutches S91, S92, S93, and S94 respectively, and each of the spring clutches is turned ON or OFF according to the phase of the corresponding cam. The cams C91, C92, C93, and C94 fixed to the shaft 102 shown in FIG. 11 are, as shown in FIG. 10, similar in shape with a concave C02 of about 90°, and mounted at an angular interval of 90°.

In the toner feeding unit with the foregoing configuration, when a pulse motor or the rotary solenoid motor M2 rotates at a predetermined angle, one of the spring clutches S91, S92, S93, and S94 enters the power transfer state and the other spring clutches enter the non-transfer state. When the motor M2 rotates so that the cams rotate in a 90° arc, the developing device is switched and the transfer spring clutch is switched to the spring clutch at the next location.

For copy, the motor M1 is in the ON state and the spring solenoid S90 is in the non-transfer state. When a specific color toner is to be fed, the motor M2 rotates at a predetermined angle, the spring clutch opposite to the appropriate cam enters the power transfer state, the solenoid SOL12 is kept ON for a predetermined time, the power is transferred in this period to rotate the gears related to the corresponding feeding toner container, and the toner is fed to the corresponding developing device in a predetermined amount.

For the rotation of the cam drive motor M2, it is preferable that the developing device drive takes precedence, the cams rotate in a 90° arc when the photosensitive drum makes one revolution, and the developing system and the toner feeding system are structured so that the feeding toner container 91 containing a yellow toner, for example, moves to the location of the cam which can feed the toner. If a developing device requires toner feeding during development when this configuration is used, the toner can be fed from the corresponding toner feeding container.

Next, the configuration and operation of pressing or releasing the transfer belt and the cleaning means to or from the photosensitive drum of such a color image forming apparatus will be described hereunder.

Figure 12:
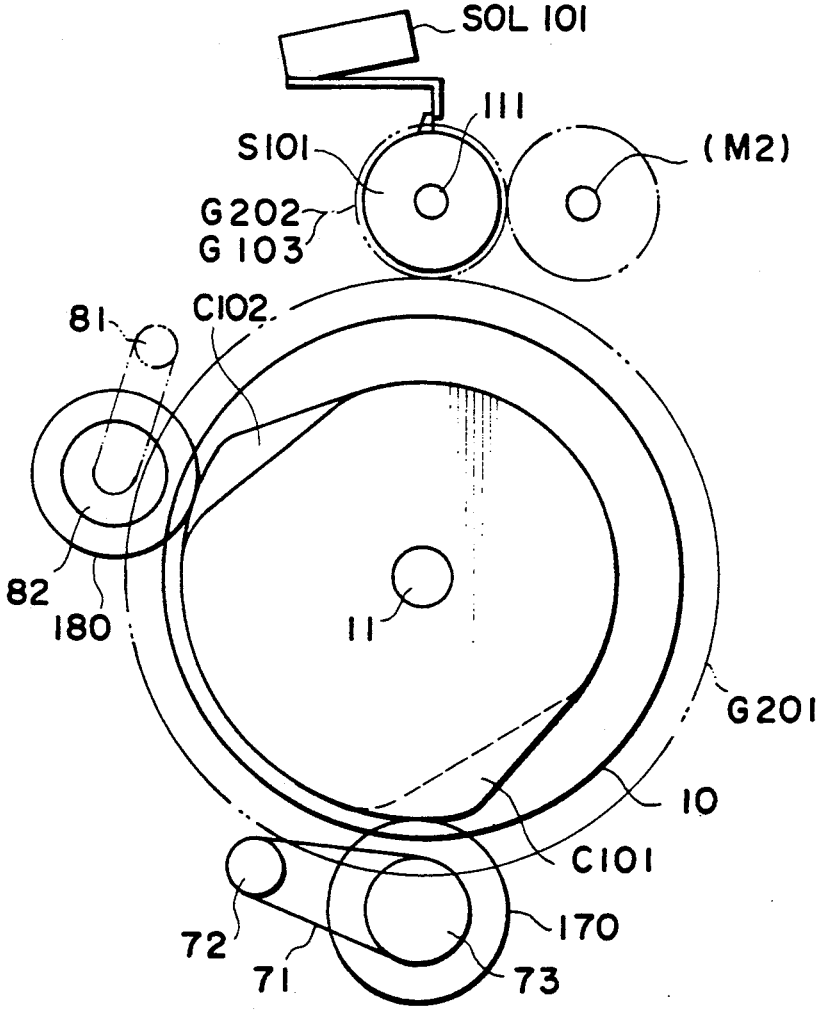
FIG. 12 is a front view of the essential section of a photosensitive drum.
Figure 13:
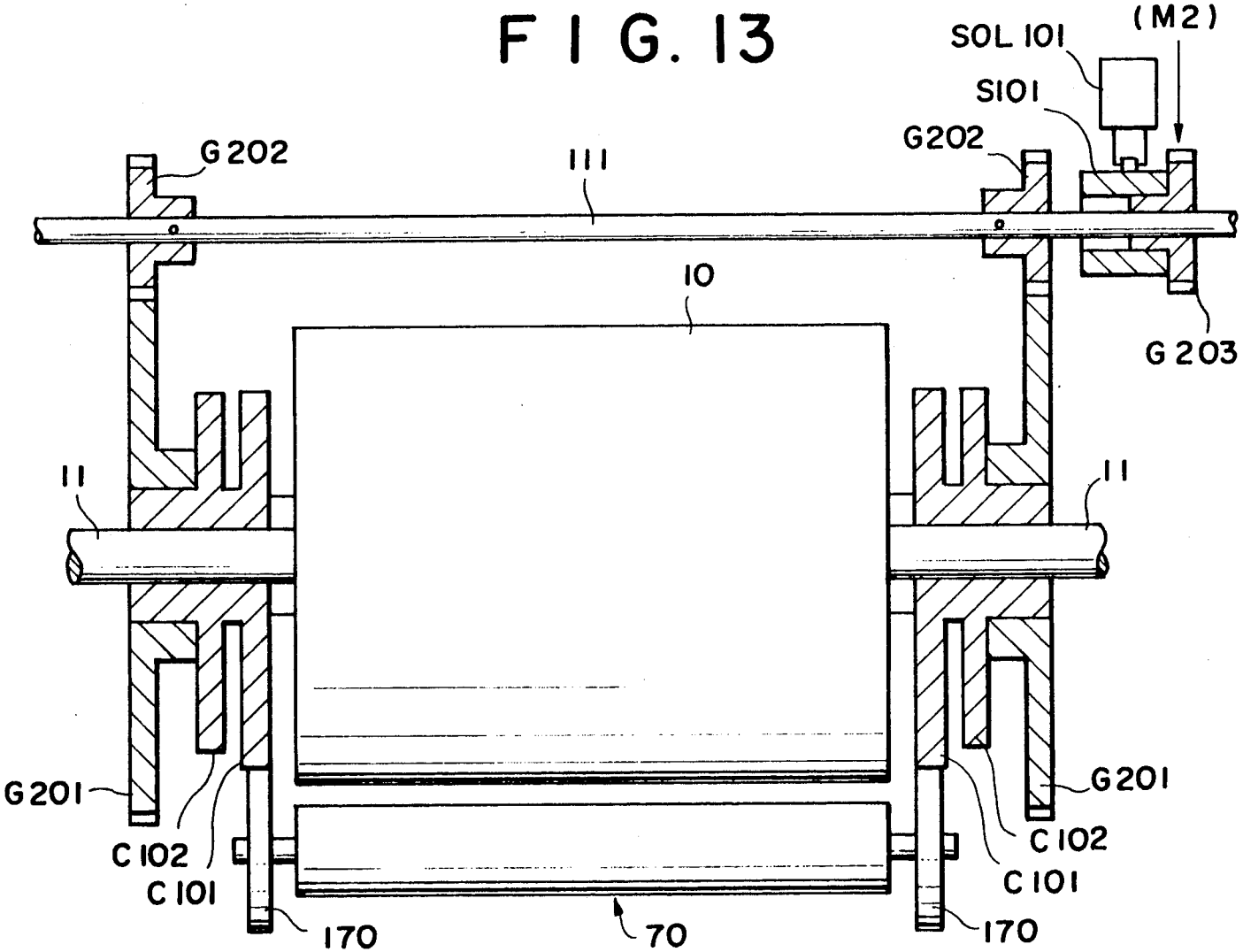
FIG. 13 is a sectional view of the essential section shown in FIG. 12.

FIG. 12 is a front view of the essential section of the photosensitive drum, and FIG. 13 is a sectional view of the essential section. Two cams C101 and C102 and a gear G201, which are integrated, are symmetrically mounted on both sides of the shaft direction of the photosensitive drum 10 respectively with each center coinciding with that of the drum shaft 11, and can rotate round the drum shaft 11. The cam C101 turns the transfer belt 71 ON or OFF, and the cam C102 turns the cleaning brush 82 ON or OFF.

Rollers 170 are mounted to the transfer unit 70 on both sides coaxially with the transfer unit 70. When the rollers 170 are in contact with the peripheral surface of the cam C101, the transfer belt 71 is away from the photosensitive drum 10.

Rollers 180 are mounted to the cleaner 80 on both sides coaxially with the cleaning brush 82. When the rollers 180 are in contact with the peripheral surface of the cam C102, the cleaning brush 82 is away from the photosensitive drum 10.

FIG. 12 shows the status of Phase I, mentioned above, in which the transfer belt 71 and the cleaning brush 82 are away from the photosensitive drum 10. Since the ON position of the transfer belt 71 and the ON position of the cleaning brush 82 are opposite to the photosensitive drum 10 at an angle of 105° between them, the cams C101 and C102 are fixed at an angle of 105° from the reference position.

The shape of the cam C101 is changed to a concave, concave, and convex at an interval of 90° toward the upper stream of the rotation direction on the basis of the position of the convex of the cam shown in FIG. 12.

The shape of the cam C102 is changed to a convex, concave and concave at an interval of 90° toward the upper stream of the rotation direction on the basis of the position of the convex of the cam shown in FIG. 12.

The gear G201 integrated with the cams C101 and C102 is engaged with a gear G202 fixed to a rotation shaft 111 in parallel with the drum shaft 11. The number of teeth of the gear G202 is a quarter of that of the gear G201, and when the rotation shaft 111 makes one revolution, the cams C101 and C102 make a quarter revolution to change the cam phase to the next one. A gear G203 is fixed to the rotation shaft 111 together with the gear G202. The gear G203 switches the developing device 41, 42, 43, or 44 by the motor M2, the rotation shaft 111 makes one revolution, the cams C101 and C102 make a quarter revolution via the gear G201, and the transfer belt 71 and the cleaning brush 82 are pressed to or released from the photosensitive drum as a part of the color image forming as shown in FIG. 7.

In a color image forming apparatus in which the transfer belt and the cleaning means are separated from the photosensitive drum and a plurality of developing devices mounted around the photosensitive drum are sequentially driven to form color images in this period, the developing devices and toner feeding members to the developing devices are driven by a common drive source, and spring clutches provide inexpensive driving and drive switching means. The transfer and cleaning operations can be switched by the same drive source inexpensively and correctly, and an excellent drive unit can be provided for a color image forming apparatus.

An embodiment of a developing drive unit for a color image forming apparatus which is the second object of the present invention and comprises developing devices which can be operated not only in the location order or in a predetermined order but also by skipping one or two developing devices; that is, can be freely selected and operated, will be described hereunder.

Figure 14:
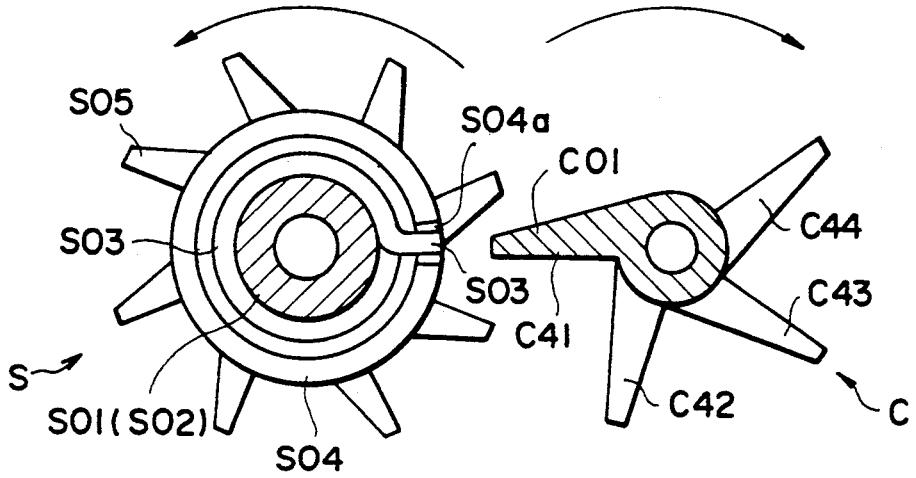
FIG. 14 is a sectional view for explaining the spring clutch operation of another embodiment of the present invention.

FIG. 14 shows a spring clutch which is preferably used in this embodiment. This spring clutch is of a so-called open type, and when the spring clutch pin and the protrusion of the cam are linked to each other, the spring clutch transfers the power. In this embodiment, the peripheral speed of the cam from the stop position to the stop position is structurally almost equal to that of the spring clutch pin at the contact point (the rotation directions are reverse). FIG. 14 shows the relative position of the section of the spring clutch and the cam, and it shows that the clutch section configuration is close to that of the closed type spring clutch shown in FIG. 1. A plurality of protruded clutch pins S05 are mounted to a sleeve S04 of this spring clutch at an equal interval, and rotate in the direction of the arrow (counterclockwise) at an almost fixed speed. A cam C opposite to the spring clutch S is a cam in a clutch pin shape. When a protrusion C01 of the cam C is stopped at a position C41 shown by diagonal lines in the figure, the protrusion C01 is in contact with the clutch pin S05 of the spring clutch S, and the spring clutch transfers the power. When the stop position of the cam C is a position C42, C43, or C44, the clutch pin S05 of the spring clutch S is not in contact with the protrusion C01 of the cam C, the sleeve S04 continues rotation, and the spring clutch S transfers no power. When a cam 41 in the contact state leaves the contact position or a cam C42 not in the contact state moves to the contact position, the cam C rotates in the direction of the arrow (clockwise) and the peripheral speed of the cam C is almost equal to that of the spring clutch S at the contact point. Therefore, when the protrusion C01 of the cam C is separated from or passes the clutch pin S05 of the spring clutch S, the protrusion C01 does not come in contact with the clutch pin S05, and the spring clutch S does not transfer the power temporarily. In this embodiment, therefore, a predetermined developing order can be changed to freely select a developing device at a skipped position so as to transfer the power.

Figure 15:
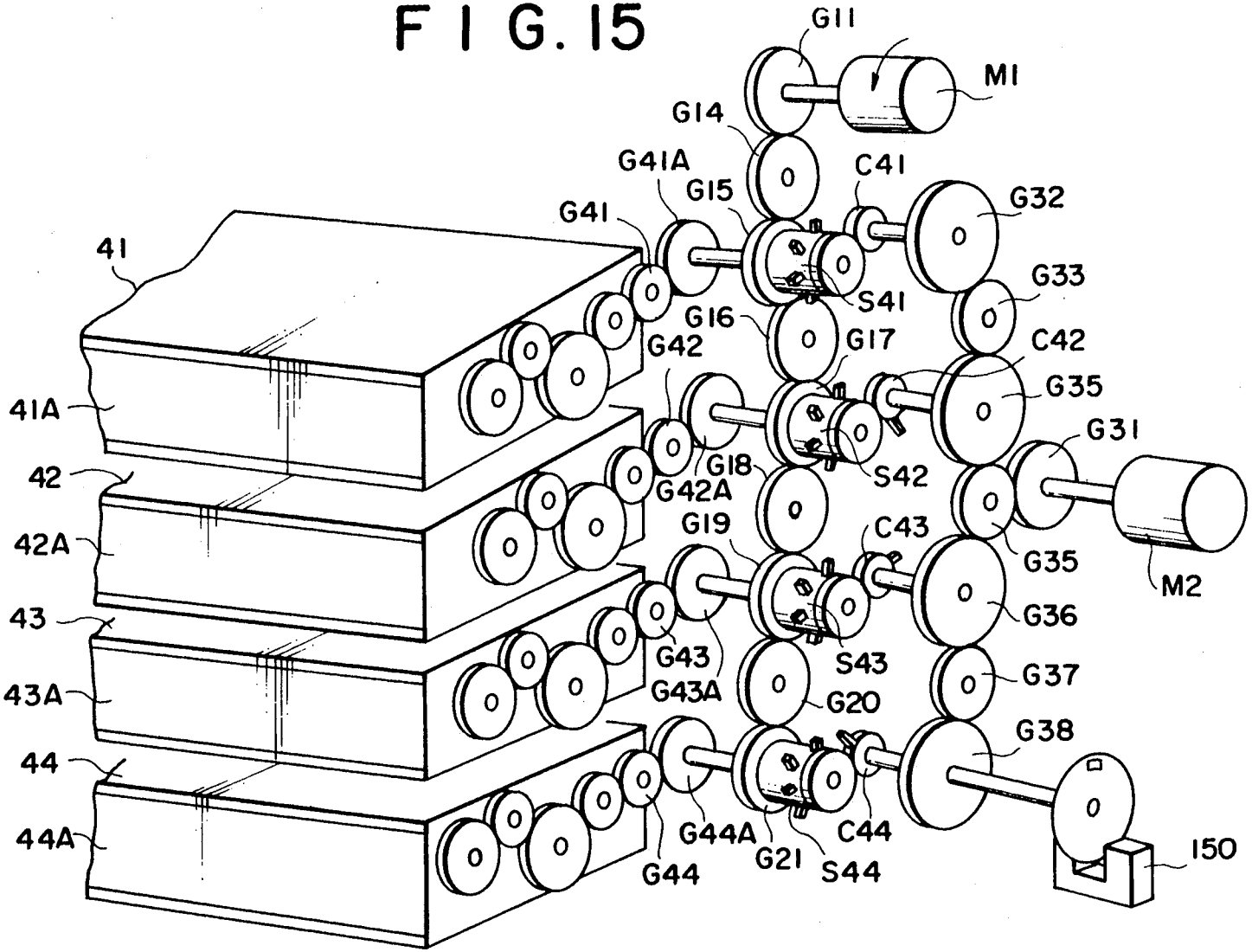
FIG. 15 is a perspective view of the drive system of the developing device.
Figure 16:
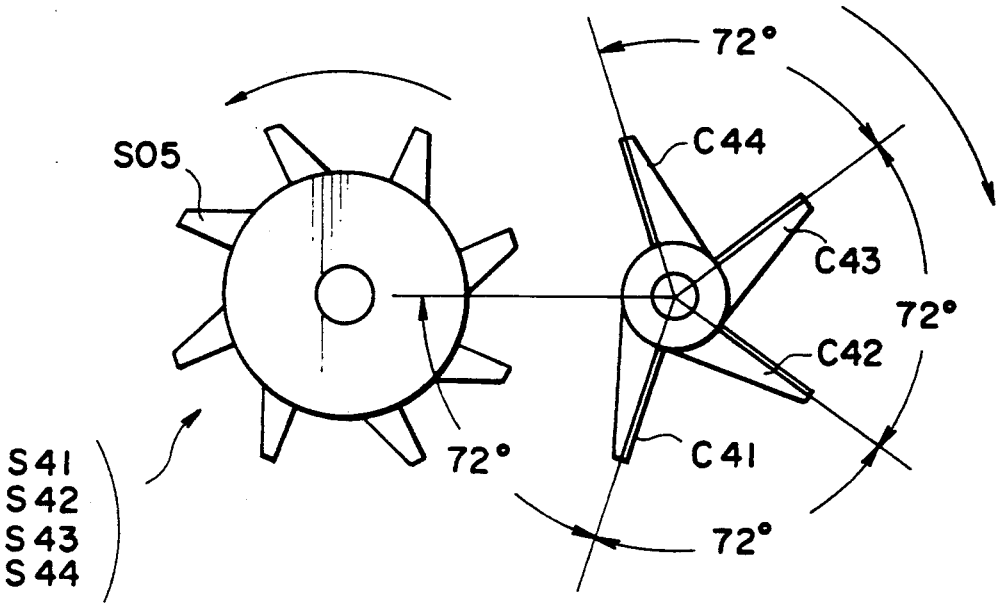
FIG. 16 is an illustration of the relationship of cam phases.

FIG. 15 shows a configuration that spring clutches shown in FIG. 14 are applied to a plurality of developing devices. FIG. 16 shows the relative phase of the cams C41, C42, C43, and C44. The cams are mounted at an angular interval of 72°; that is, the angle of 360° is equally divided by 5, and the cams are located so that the protrusions C01 are located in the four directions. The relative position shown in FIG. 16 is the reference position.

In a developing drive unit with the above configuration, when the motor M1 is turned ON for copy, the spring clutches S41, S42, S43, and S44 do not transfer the power and the developing devices 41, 42, 43, and 44 do not operate. For development, the control unit drives the motor M2 to rotate the cams in a 72° arc in the direction of the arrow (clockwise) and to stop at the position. By doing this, the cam C41 comes in contact with the spring clutch S41 and the power is transferred to the developing device 41. When the cams are furthermore rotated in a 72° arc in the direction of the arrow and stopped at the position, the power transferred to the developing device 41 is stopped, the cam C42 comes in contact with the spring clutch S42 instead, and the power is transferred to the developing device 42. When the cams are furthermore rotated in a 72° arc in the direction of the arrow in the same way and stopped at the position, the cam C43 comes in contact with the spring clutch S43, and the developing device 43 operates instead of the developing device 42. When the cams are furthermore rotated in a 72° arc in the direction of the arrow, the operation is switched to the developing device 44.

In the above description, the time interval required for switching the developing device is short. When a considerable halt time is required to switch, for example, the developing device 41 to the developing device 42, an appropriate halt time can be set by controlling the cams to rotate in a ($n \times 360° + 72°$) arc and stop. To switch, for example, the developing device 41 to the developing device 43 by skipping the developing device 42, the cam of the developing device in operation (at the position at an angle of 72° from the reference position) can be rotated in a 144° arc in the direction of the arrow (to the position at an angle of 216° from the reference position) and stopped at the position. By this control, a free operation can be selected or the operation can be stopped for any of the developing devices. By performing cyclically the developing drive operation shown in the time chart in FIG. 7, color images are formed.

At the end of the above operation, it is preferable that the cams are stopped at the initial positions (the cam positions shown in FIG. 16). For that purpose, the position sensor 150 shown in FIG. 15 can be mounted in the cam drive system to detect the cams at the end of the operation and to rotate and stop the cams at the initial positions.

The present invention provides a developing drive unit of a color image forming apparatus at a low price, in which 3 or 4 developing devices are mounted around an image carrying member, the developing devices are sequentially or selectively driven to form color images, and the developing devices are driven or switched by spring clutches inexpensively.

What is claimed is:

1. An apparatus for switching and driving a plurality of driven systems having a plurality of driven shafts, respectively, said apparatus comprising:

a driving shaft coupled to a drive motor;

a control shaft coupled to a position control motor;

a plurality of spring clutches and a plurality of cams each corresponding in number to the plurality of driven systems, each of the plurality of spring clutches including an input shaft connected to said driving shaft, an output shaft connected to one of said plurality of driven shafts, and a clutch member associated with one of the plurality of cams, for providing selected engagement and disengagement between said input shaft and said output shaft in response to a position of an associated cam;

said plurality of cams being connected to the control shaft so that each of the plurality of driven shafts is intermittently coupled via said clutch member with the driving shaft in accordance with a rotational position of said control shaft, wherein the input shafts of said plurality of spring clutches are connected tot he driving shaft through a gear train.

2. The apparatus of claim 1, wherein the plurality of cams are mounted in tandem on the control shaft.

3. The apparatus of claim 1, wherein the plurality of cams are connected to the control shaft through a gear train.

4. An apparatus for switching and driving a plurality of driven systems having a plurality of driven shafts, respectively, said apparatus comprising:

a driving shaft coupled to a drive motor;

a control shaft coupled to a position control motor;

a plurality of spring clutches and a plurality of cams each corresponding in number to the plurality of driven systems, each of the plurality of spring clutches including an input shaft connected to said driving shaft, an output shaft connected to one of said plurality of driven shafts, and a clutch member associated with one of the plurality of cams, for providing selected engagement and disengagement between said input shaft and said output shaft in response to a position of an associated cam;

said plurality of cams being connected to the control shaft so that each of the plurality of driven shafts is intermittently coupled via said clutch member with the driving shaft in accordance with a rotational position of said control shaft, wherein the input shafts of said plurality of spring clutches are connected to the driving shaft through a gear train.

5. The apparatus of claim 4, wherein the plurality of input shafts are mounted in tandem on the driving shaft.

6. The apparatus of claim 4, wherein the input shafts of said plurality of spring clutches are connected to the driving shaft through a gear train.

7. An apparatus for switching and driving a plurality of driven systems having a plurality of driven shafts, respectively, said apparatus comprising:

a driving shaft coupled to a drive motor;

a control shaft coupled to a position control motor;

a plurality of spring clutches and a plurality of cams each corresponding in number to the plurality of driven systems, each of the plurality of spring clutches including an input shaft connected to said driving shaft, an output shaft connected to one of said plurality of driven shafts, and a clutch member associated with one of the plurality of cams, for providing selected engagement and disengagement between said input shaft and said output shaft in response to a position of an associated cam;

said plurality of cams being connected to the control shaft so that each of the plurality of driven shafts is intermittently coupled via said clutch member with the driving shaft in accordance with a rotational position of said control shaft;

wherein the clutch member has a pin positioned for coming in contact with an associated cam at a contact area to be actuated by such associated cam, and wherein the pin is rotated by the driving shaft so as to have the same circumferential speed at the contact area as that of the cam.

8. The apparatus of claim 7, wherein the input shafts of said plurality of spring clutches are mounted in tandem on the driving shaft.

9. The apparatus of claim 7, wherein the input shafts of said plurality of spring clutches are connected to the driving shaft through a gear train.

10. The apparatus of claim 7, wherein the plurality of cams are mounted in tandem on the control shaft.

11. The apparatus of claim 7, wherein the plurality of cams are connected to the control shaft through a gear train.

12. An apparatus for switching and driving a plurality of developing devices, each of which has developing means driven through a first driven shaft and toner feeding means driven through a second driven shaft, comprising:

a first driving shaft;

a plurality of first clutches, a plurality of first cams, a plurality of second clutches and a plurality of second cams each corresponding in number to the plurality of developing devices;

each of the plurality of first clutches, connected to the first driving shaft and associated with one of the plurality of first cams, includes means for providing selective engagement and disengagement between the first driving shaft and said first driven shaft in response to an actuation of an associated first cam;

a second driving shaft;

a common shaft;

a common clutch including means for providing selective engagement and disengagement between the second driving shaft and the common shaft in response to a toner feeding signal;

each of the plurality of second clutches, connected to the common shaft and associated with one of the plurality of second cams, includes means for providing selective engagement and disengagement between the common shaft and said second driven shaft in response to an actuation of an associated cam;

a control shaft coupled to a position control motor; and each of the plurality of first cams and each of the plurality of second cams connected to the control shaft so that a first cam and a second cam used for the same developing device have the same cam angle in relation to a rotational position of the control shaft.

13. The apparatus of claim 12, wherein the first driving shaft and the second driving shaft are coupled with the same drive motor.

14. An apparatus for switching and driving a plurality of developing devices, cleaning means and transfer means which are provided around the periphery of a photoreceptor drum of an image forming apparatus, comprising:

a driving shaft coupled with a drive motor;

a control shaft coupled with a position control motor;

a plurality of clutches and a plurality of cams corresponding in number to the plurality of developing devices;

each of the plurality of clutches, connected to the driving shaft and associated with one of the plurality of cams, for engaging or disengaging between the driving shaft and one of the plurality of developing devices in response to an actuation of an associated cam;

the plurality of cams connected to the control shaft so that each of the plurality of developing devices is intermittently engaged with the driving shaft in accordance with a rotational position of the control shaft;

a driving cam for bringing the cleaning means and the transfer means in or out of contact with the photoreceptor drum, the driving cam connected to the control shaft so that the cleaning means and the transfer means are intermittently brought in contact with the photoreceptor drum in accordance with a rotational position of the control shaft.

15. The apparatus of claim 14, wherein the plurality of developing devices consists of four sets of developing devices differing in colors.

16. The apparatus of claim 15, wherein the driving cam is adapted to rotate once for every four rotations of the control shaft.

17. An apparatus for switching and driving a plurality of driven shafts, comprising:

a driving shaft coupled with a drive motor;

a control shaft;

means for controlling a rotational position of said control shaft;

a plurality of clutches and a plurality of cams each corresponding in number to the plurality of driven shafts;

said plurality of cams being connected to said control shaft so as to be rotated by the rotation of the control shaft;

each of the plurality of clutches including:

an input shaft connected to said driving shaft;

an output shaft connected to one of the plurality of driven shafts, and a clutch means, associated with one of said plurality of cams and cooperating with such associated cam, to selectively provide engagement and disengagement between said input and output shafts in accordance with the rotational position of the control shaft.

18. The apparatus of claim 17, wherein said clutch means includes a pin, and wherein each of the plurality of cams is rotatable to (a) an actuating position at which said pin is actuated by said associated cam to provide one of said engagement and disengagement conditions, and (b) a non-actuating position at which said pin is not actuated by said associated cam to provide the other of said engagement and disengagement conditions.

19. The apparatus of claim 18, wherein said clutch means provides engagement between said input and output shafts at the actuating position and provides disengagement therebetween for the non-actuating position.

20. The apparatus of claim 18, wherein said clutch means provides engagement between said input and output shafts at the non-actuating position and provides disengagement therebetween for the actuating position.

* * * * *